United States Patent [19]

Yonushonis et al.

[11] 4,389,282

[45] Jun. 21, 1983

[54] CERAMIC FIBER BOARD

[75] Inventors: Celeste Yonushonis, Paoli, Pa.; Thomas E. Walters, Johnson City, Tenn.

[73] Assignee: Combustion Engineering, Inc., Windsor, Conn.

[21] Appl. No.: 405,971

[22] Filed: Aug. 6, 1982

[51] Int. Cl.[3] ..... D21H 5/18

[52] U.S. Cl. ..... 162/145; 162/152; 162/168.1; 162/168.3

[58] Field of Search ..... 162/145, 152, 156, 168.1, 162/168.3, 169, 183

[56] References Cited

U.S. PATENT DOCUMENTS

| | | | |
|---|---|---|---|
| 4,269,887 | 5/1981 | Sonobe et al. | 162/145 |
| 4,308,093 | 12/1981 | Bodendorf et al. | 162/152 |

FOREIGN PATENT DOCUMENTS

| | | | |
|---|---|---|---|
| 631848 | 11/1961 | Canada | 162/156 |
| 47-24165 | 7/1972 | Japan | 162/152 |
| 52-21016 | 2/1977 | Japan | 162/156 |

*Primary Examiner*—Peter Chin

*Attorney, Agent, or Firm*—Richard H. Berneike

[57] ABSTRACT

A flexible ceramic fiber board is formed from fibers with a homogeneous latex binder coating. The coating is formed from a slurry of the latex, a cationic acrylamide base copolymer and aluminum sulfate solution. The cationic copolymer aids the aluminum sulfate in homogeneously depositing the latex and forming a uniformly flexible board. The shape that is formed is dried dielectrically. The crystalline, high $Al_2O_3$ fibers may be mixed with non-crystalline, $Al_2O_3.SiO_2$ fibers.

2 Claims, No Drawings

CERAMIC FIBER BOARD

BACKGROUND OF THE INVENTION

This invention relates to flexible ceramic fiber boards containing a latex binder.

Ceramic fibers are widely used in the fabrication of blankets, felts and boards for high temperature insulation. These are used primarily for lining furnaces. Such products may contain non-crystalline aluminosilicate fibers, crystalline high alumina fibers or a mixture of the two types of fibers. Non-crystalline or amorphous fibers are ceramic fibers formed from a melt. The molten composition is fiberized by spinning or blowing and then quenching rapidly to retain a non-crystalline structure. Crystalline ceramic fibers are generally produced by heat treating a precursor fiber containing chemical compounds which convert to high temperature oxides upon heat treating. The precursor fibers are made by textile processing techniques such as dry spinning of solutions or by spinning of a viscose solution through orifices of a rotating disc. The heat treating process is usually a complex process involving decomposition, oxidation, rearrangement of molecular structure and sintering. This long heat treating process results in a crystalline form of ceramic fiber. The non-crystalline aluminosilicate fibers generally have high mechanical strength and comparatively high shrinkage while the crystalline high alumina fibers have lower mechanical strength and lower shrinkage. Mixtures of the fibers are used to obtain the benefits of each type.

Boards formed from ceramic fibers with a latex binder have also been used in the past. These boards are formed by a wet process whereby the fibers and binder are dispersed in water to form a slurry. The slurry is brought into contact with a porous mold and a vacuum is drawn on the other side of the mold to attract the fibers to the mold surface. This forms a shape of the fibers and binder on the mold. The shape is then removed from the mold and dried to form the board.

SUMMARY OF THE INVENTION

The present invention involves a flexible ceramic fiber board containing a latex binder. The amount of latex required is reduced from the amount that is conventionally used through the use of a retention aid which places a charge on the fibers to assist in depositing the latex. The quality of the board product is improved since a homogeneous latex network is deposited which results in uniform flexibility and uniform binding of the fibers.

DESCRIPTION OF THE PREFERRED EMBODIMENTS

The present invention involves the use of crystalline high alumina fibers alone or in combination with non-crystalline aluminosilicate fibers. Crystalline high alumina fibers are composed of at least about 60% alumina ($Al_2O_3$) and preferably from 80–100% alumina with the remainder being essentially silica ($SiO_2$). The non-crystalline aluminosilicate fibers are mainly composed of about 40–70% by weight of alumina and 30–60% silica. They may contain small quantities of metal oxides as impurities or additional components. Both the crystalline alumina fibers and the non-crystalline aluminosilicate fibers are commercially available products and various methods of producing them are well known. The range of fiber length that may be used is 3.2 mm to 50.8 mm and preferably about 28.5 mm.

The range of the composition of the present invention and the preferred composition expressed in weight percent are illustrated by the following tables:

| | Range | Preferred |
|---|---|---|
| **Fiber Mixture** | | |
| Crystalline High $Al_2O_3$ Fiber | 10–100 | 37.5 |
| Non-Crystalline $Al_2O_3.SiO_2$ Fiber | 0–90 | 62.5 |
| **Batch Composition** | | |
| Fiber Mixture | 74.5–96.8 | 93.0 |
| Cationic Acrylamide Base Copolymer | 0.1–5.0 | 0.4 |
| Acrylic Latex | 3–20 | 6.4 |
| Aluminum Sulfate | 0.1–0.5 | 0.2 |

The percentage of aluminum sulfate is the weight of dry (100%) aluminum sulfate but it is added in the form of a solution, preferably a 10% solution. The preferred amount of aluminum sulfate is that amount required to form clear water indicating that the latex has been fully deposited from the slurry. An example of a latex which may be used is Hycar Latex #2671 manufactured by B. F. Goodrich. An example of the cationic acrylamide-base copolymer is Reten 210 manufactured by Hercules. The constituents of the binder system, the acrylamide-base copolymer, acrylic latex and aluminum sulfate, are added in that order with rapid agitation. Since ceramic fibers are inert materials, they require a surface treatment in order to obtain a surface activity which allows the latex polymer particles to deposit and adhere to the fibers. This treatment is accomplished by use of the copolymer retention aid which places a charge on the fibers and assists the aluminum sulfate in homogeneously depositing the latex to form a uniformly flexible product.

Following the vacuum forming of the shapes from the slurry, they are dried in a dielectric oven. The wet ceramic fiber shape acts as a dielectric insulation between the elements of the capacitor of the oven. This high dielectric constant allows the water molecules to absorb energy from a high voltage radio frequency field. This absorbed energy drops off as the water is driven off to a point where no further heating occurs. In other words, the drying action is self-limiting with the temperature seldom going much over 212° F. This prevents overheating and degradation of the latex as can readily occur with conventional heating. The drying is also rapid as compared to conventional drying which limits the time in which there can be any migration of the latex binder. This effect of dielectric drying cannot be fully achieved by conventional gas drying. The dried boards exhibit good flexibility and have a bulk density range from about 8 to 13 pounds per cubic foot.

We claim:

1. A method of forming a uniformly flexible ceramic fiber board comprising the steps of:
   a. forming a slurry of:
      1. 74.5–96.8 weight percent of ceramic fibers,
      2. 0.1–5 weight percent of a cationic acrylamide base copolymer,
      3. 3–20 weight percent of an acrylic latex, and
      4. 1–15 weight percent of aluminum sulfate; whereby said acrylic latex is deposited homogeneously on said fibers.
   b. vacuum forming a shape of said latex coated fibers from said slurry, and
   c. drying said shape dielectrically to form said board.

2. A method as recited in claim 1 wherein said ceramic fiber comprises from 10 to 100 weight percent crystalline high alumina fiber and 0–90 weight percent non-crystalline aluminosilicate fiber.

* * * * *